United States Patent [19]

Haaga

[11] 3,937,174

[45] Feb. 10, 1976

[54] SWEEPER HAVING AT LEAST ONE SIDE BRUSH

[76] Inventor: Hermann Haaga, Im Dinkelacker 2, 7000 Stuttgart-Oberturkheim, Germany

[22] Filed: Dec. 21, 1973

[21] Appl. No.: 427,302

[30] Foreign Application Priority Data

Dec. 21, 1972 Germany ..... 2262648

[52] U.S. Cl. ..... 15/42; 15/87

[51] Int. Cl.[2] ..... A47L 11/32

[58] Field of Search ..... 15/41 R, 42, 87

[56] References Cited

UNITED STATES PATENTS

| | | | |
|---|---|---|---|
| 500,976 | 7/1893 | Tangenberg | 15/42 |
| 801,882 | 10/1905 | Knell | 15/42 |
| 3,748,679 | 7/1973 | Rosendall | 15/42 |

FOREIGN PATENTS OR APPLICATIONS

| | | | |
|---|---|---|---|
| 1,923,908 | 11/1970 | Germany | 15/42 |

*Primary Examiner*—Edward L. Roberts

*Attorney, Agent, or Firm*—Craig & Antonelli

[57] ABSTRACT

A sweeper having at least one laterally arranged side brush rotatably mounted about a rotational axis inclined with respect to the vertical axis of the sweeper and having bristles arranged in a pattern about the rotational axis, and a drive mechanism responsive to the lateral displacement of the sweeper over the surface being swept for rotating the side brush in a predetermined direction of rotation about the rotational axis independently of the direction of lateral displacement of the sweeper.

8 Claims, 4 Drawing Figures

SWEEPER HAVING AT LEAST ONE SIDE BRUSH

Figure 1:
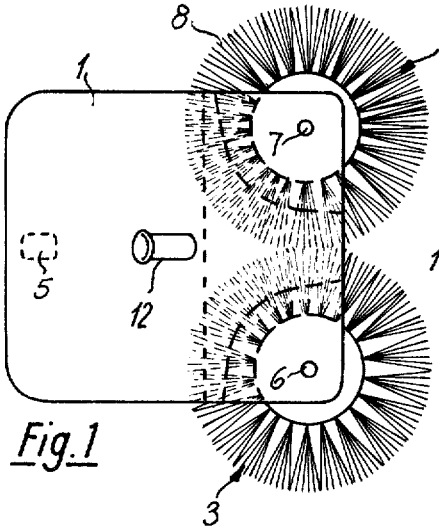

This invention relates to a sweeper such as for carpets or the like having at least one laterally arranged side brush rotatably mounted about an axis inclined with respect to the vertical axis with the bristles of the brush being oriented obliquely downwardly and outwardly and arranged in a circular or wreath-like manner at the base member of the side brush. The drive unit of the side brush includes a drive roller pivotably mounted to the machine in the manner of a guide and idler roll, which is disposed within the bristle crown and is in operative connection with a toothed rim or gear concentric to the axis of the side brush.

A sweeper of the type mentioned above is conventional as disclosed in DOS [German Unexamined Published Application] 2,055,841. The axis of rotation in such a side brush is inclined with respect to the vertical, so that the side brush contacts the ground in only a certain zone with its bristles. As a consequence, a defined sweeping direction is obtained. The conventional type of structure has the advantage that the drive roll is arranged protected within the side brush, and that a very simple drive is obtained. Additionally, it is possible to sweep very closely in corners or the like by means of the side brush.

In order to maintain the drive derived from the drive roller constantly in engagement with the side brush, the conventional type of structure provides that the side brush pivots with the roller about the pivot axis of the latter, so that its axis of rotation is likewise pivoted eccentrically with respect to the pivot axis of the idler roll. By this pivoting of the axis of rotation of the side brush, this axis of rotation is inclined to the vertical toward one or the other direction, in dependence on the advancing direction of the sweeper, so that respectively a different zone of the bristles of the side brush contacts the ground. Consequently, the sweeping direction of the side brush changes with the advancing direction, although its direction of rotation is preserved. This is disadvantageous insofar as there is the danger that, during the reverse motion of the sweeper, dirt is swept by the side brush back into the already swept area.

The invention is based on the problem of constructing a sweeper of the type mentioned above so that the sweeping direction of the side brush or brushes remains the same, independently of the advancing direction of the sweeper, so that the objective is attained that during forward as well as backward movement and also in case of a turn, the side brushes always sweep toward the center of the power sweeper.

In accordance with a feature of the present invention, a trunnion or pin member is rotatably mounted to the sweeper and extends at least approximately coaxially to the axis of the side brush. The coaxially extending pin member extends into a crank or offset axle portion containing a section part extending at right angles and offset with respect to the pin member. A roll is mounted on the offset axle portion and is connected for rotation with a gear wheel which gear wheel meshes with a toothed rim of the side brush. This construction has the effect that the axis represented by the axle of the side brush is held in a fixed position at the sweeper, so that its inclination cannot vary. Since the direction of rotation does not change with the travel direction, either, the sweeping direction or direction of rotation of the side brush toward the center remains the same, independently of the travel direction. The drive connection is preserved, because the gear wheel coupled with the idler roll travels around the toothed rim of the side brush without being disengaged therefrom.

Figure 2:
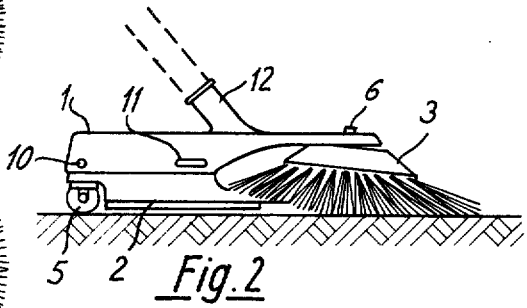
Figure 3:
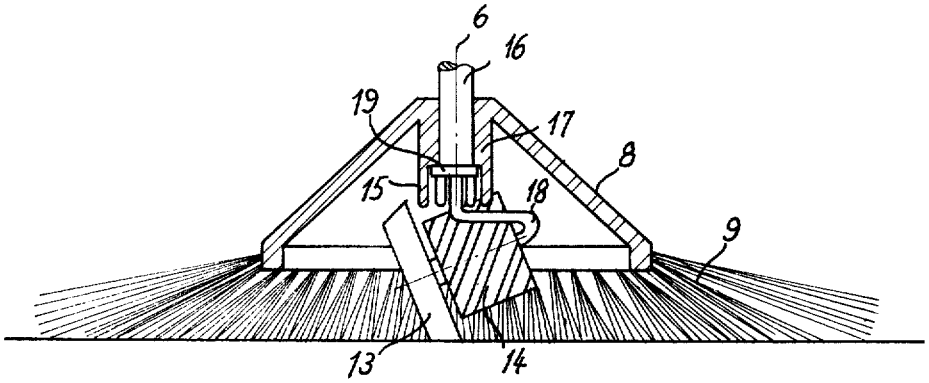
Figure 4:
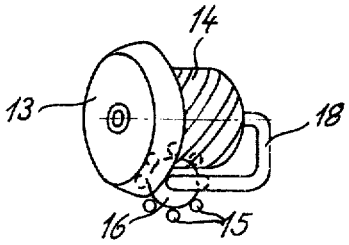

These and further objects, features and advantages of the present invention will become more obvious from the following description when taken in connection with the accompanying drawings which show, for purposes of illustration only, a single embodiment in accordance with the present invention, and wherein FIG. 1 shows a top view of a sweeper constructed in accordance with this invention, FIG. 2 shows a lateral view of the sweeper of FIG. 1, FIG. 3 shows a section through a side brush of the carpet sweeper according to FIGS. 1 and 2 on an enlarged scale, and FIG. 4 shows a view from below onto the drive visible in FIG. 3.

Referring now to the drawings wherein like reference numerals are utilized to designate like parts throughout the several views, there is illustrated in FIGS. 1 and 2 a manual sweeper which can be called a type of self-sweeping dust pan. The sweeper includes an upper housing section 1 and a shovel-type receiving section 2 and is provided with two side brushes 3 and 4 in the zone of its front corners. At the rear, the sweeper is equipped with a small guide roll 5. The side brushes 3 and 4 can be rotated about rotary axles or pin members 6 and 7 having axes which are inclined toward the front and toward the center of the sweeper. In this way, the side brushes 3 and 4, consisting of a conical base member 8 with a circular contour carrying on its rim natural or synthetic-resin bristles 9, exert their sweeping effect essentially in the front zone before the sweeper and in the region between the two side brushes 3 and 4, since the bristles 9 contact the ground especially in this zone.

The receiver section 2 has the shape of a shovel with its front portion being oriented obliquely downwardly toward the ground. This portion has a tongue as shown in dashed line in FIG. 1 which extends into the zone between the two side brushes 3 and 4. The bristles 9 of the side brushes 3 and 4 travel onto this inclined zone of the shovel-like receiver 2. The lateral edges of the receiver 2 are slightly bent upwardly at least in the region of the side brushes 3 and 4, so that they form strip-off edges for the side brushes rotating in opposite directions. In order to collect the dirt in the receiver, an edge follows the portion engaged by the bristles 9 of the side brushes 3 and 4, separating a depressed section arranged behind this edge from the front zone covered by the sweep of the bristles. The receiver 2 is mounted in the rearward region of the upper housing section 1 to be pivotable about an axle 10. Approximately in the center, an easily releasable locking device 11 is provided so that the receiver 2 can be flipped away from the upper housing section 1 and can be emptied. The upper housing section 1 has a holder 12 for a handle or the like.

The drive for the side brushes 3 and 4 is mounted in the space enclosed by the base members 8 and the bristles 9, so that a very compact construction is obtained which travels in most cases only over already swept surfaces. The drive of each side brush 3 and 4 contains a roller 13 connected for rotation with a gear wheel 14 having obliquely extending helical teeth. Pin-like projections 15 of the base member 8 engage the gear wheel 14 which projections are arranged concentrically about the axis of rotation 16 and in parallel to the axis of rotation 16 of the pin members 6 and 7 as shown in FIGS. 3 and 4. The base member 8 is rotatably mounted with a sleeve 17 on the trunnion 6, the lower end of the sleeve 17 forming the pin-like teeth 15 as a gear member. It is also possible to hold the pin member 6 in a bearing sleeve carrying on the outside thereof the sleeve 17 of the side brush. The pin member 6 proper is rotatably mounted in the upper housing section 1 in a manner not illustrated in detail and is extended downwardly with an offset axle 18 receiving the roller 13 and the gear wheel 14. The axle 18 projects, as shown in FIG. 3, downwardly past the pin-like teeth 15 and is then bent into a section extending at right angles to the axis of rotation 6. This section carries the roller 13 and the gear wheel 14.

The section of the bent axle 18 receiving the roller 13 and the gear wheel 14 is oriented obliquely with respect to the horizontal, so that the contact point for the roller 13 on the ground, as seen in the travel direction, is exactly behind the axis of rotation 6 of the side brush 3 or 4. This position is automatically assumed by the roller 13 due to the occurring motion resistances as soon as the sweeper is shifted. This ensures, on the one hand, that the predetermined direction of rotation is maintained for both side brushes 3 and 4 in all displacement directions. It is to be kept in mind that the axles 18 of the two side brushes 3 and 4 are bent in mirror symmetry with respect to the center of the sweeper, wherein also the rollers 13 and the gear wheels 14 are disposed in corresponding mirror symmetry on the axles. This arrangement furthermore has the effect that, during the movement of the sweeper, no torque is exerted on the trunnion 6 which could lead to an inclined positioning of the rollers 13 with respect to the travel direction. Such an oblique positioning could strongly reduce the effect of the drive, especially if the friction values between the roller and the ground are not especially favorable.

Moreover, the side brushes 3 and 4 can be very easily mounted with their drive means, since the base members 8 of the side brushes 3 and 4 are disposed on the pin members 6 and/or on a bearing sleeve, and are also supported in the vertical direction by a collar 19.

Obviously, many modifications and variations of the present invention are possible in the light of the above teachings. It should therefore be understood that within the scope of the appended claims, the invention may be practiced otherwise than as specifically described.

I claim:

1. Sweeper comprising at least one laterally arranged side brush rotatably mounted about a rotational axis inclined with respect to the vertical axis of the sweeper, said side brush including a base member having bristles arranged in a pattern about the rotational axis and extending downwardly and outwardly from said base member, and drive means responsive to the lateral displacement of the sweeper over the surface being swept for rotating said side brush in a predetermined direction of rotation about the rotational axis independently of the direction of lateral displacement of the sweeper, said bristles of said side brush being arranged in a circular pattern and said drive means including roll means for frictionally engaging the surface being swept, said roll means being disposed within the bristle crown and mounted for pivotal movement about the rotational axis, said roll means operatively engaging gear means concentrically disposed about the rotational axis of said side brush.

2. Sweeper according to claim 1, wherein said drive means further includes pin means rotatably mounted at the sweeper and having a first portion extending at least approximately coaxially to the rotational axis of said side brush, said pin means including a second portion extending from said first portion and forming a crank axle having a section extending at right angles and offset with respect to said first portion, said section having said roll means mounted for rotation thereon.

3. Sweeper according to claim 2, wherein said drive means further includes a gear member connected for rotation with said roll means and in meshing engagement with said gear means, said gear means being connected to said side brush for rotation in accordance with the movement of said gear member.

4. Sweeper according to claim 3, wherein said section of said second portion which serves for mounting said roll means is inclined with respect to the horizontal.

5. Sweeper according to claim 4, comprising two laterally arranged side brushes positioned at the front end of the sweeper, and a drive means for each side brush for rotating said side brushes in opposite directions about the respective rotational axis of each side brush.

6. Sweeper according to claim 3, wherein said side brush includes a sleeve member connected to said base member and mounted for rotation about said first portion of said pin means, said gear means being pin-like projections extending from one end of said sleeve member for meshing engagement with said gear member.

7. Sweeper according to claim 6, wherein said gear member is a gear wheel mounted for rotation on said section of said second portion.

8. Sweeper according to claim 1, comprising two laterally arranged side brushes positioned at the front end of the sweeper, and a drive means for each side brush for rotating said side brushes in opposite directions about the respective rotational axis of each side brush.

* * * * *